US006264507B1

(12) United States Patent
Fukamachi

(10) Patent No.: US 6,264,507 B1
(45) Date of Patent: Jul. 24, 2001

(54) TERMINAL FITTING WITH UPSTANDING PROJECTION

(75) Inventor: Makoto Fukamachi, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/580,924

(22) Filed: May 26, 2000

(30) Foreign Application Priority Data

Jun. 18, 1999 (JP) ..... 11-173326

(51) Int. Cl.[7] ..... H01R 13/514
(52) U.S. Cl. ..... 439/752
(58) Field of Search ..... 439/595, 752

(56) References Cited

U.S. PATENT DOCUMENTS 3,781,760 * 12/1973 Mancini et al. ..... 439/752
4,690,477 * 9/1987 Doutrich et al. ..... 439/752
5,651,703 * 7/1997 Sasai ..... 439/752

* cited by examiner

*Primary Examiner*—Brian Sircus
*Assistant Examiner*—Phuong K T Dinh
(74) *Attorney, Agent, or Firm*—Banner & Witcoff, Ltd.

(57) ABSTRACT

A detecting protrusion 42 of an electrical terminal is formed by cutting out a posterior portion of an opposing face 39 of main body 31, this detecting protrusion 42 protruding upwards. If a terminal fitting 30 to be inserted into a cavity 11 is only half-inserted, when a retainer 20 is pressed towards a main stopping position, a lower face 24 of a stopping member 21 strikes against an upper face 44 of the detecting protrusion 42, thereby preventing the retainer 20 from being pressed in. As a result, the half-insertion of the terminal fitting 30 can be detected. The retainer 20 is in a more shallowly inserted state compared to the case where movement of the retainer 20 is prevented by the lower face 24 of the stopping protrusion 21 striking against the opposing face 39, the amount of protrusion of the retainer 20 being determined by the height of the detecting protrusion 42.

17 Claims, 6 Drawing Sheets

TERMINAL FITTING WITH UPSTANDING PROJECTION

TECHNICAL FIELD

The present invention relates to an electrical terminal fitting, doubly retained by a retainer.

BACKGROUND TO THE INVENTION

FIG. 11 of this specification shows an example of a terminal fitting which is inserted within a connector housing provided with a retainer. This terminal fitting 1 consists of a box-shaped main body 2 provided at the anterior, and attaching members 3 for crimping electric wires provided at the posterior. When the terminal fitting 1 is in an inserted state within a cavity 5 of a connector housing 4, it is retained by a lance 5A which protrudes from an upper face of the cavity 5, and is doubly retained by a retainer 6 which is inserted from a lower face side of the cavity 5. The retainer 6 is provided with a stopping member 6A which is capable of engaging with a posterior side face 2A of the main body 2 of the terminal fitting 1. The retainer 6 can be attached to the connector housing 4 in a temporary stopping position, whereby the stopping member 6A is removed from the cavity 5 and the terminal fitting 1 can be inserted, and a main stopping position, whereby the retainer 6 is pressed inwards from the temporary stopping position and the stopping member 6A protrudes into the cavity 5 and retains the terminal fitting 1. This type of terminal fitting is described in JP 6-58570.

If the retainer 6 is pressed into the main stopping position when the terminal fitting 1 is in a half-inserted state, the stopping member 6A strikes against a lower face 2B of the main body 2 which faces the retainer 6. By this means, the retainer 6 remains in a protruding state and its movement is halted at a position short of its main stopping position. The protrusion of the retainer 6 allows one to detect that the terminal fitting 1 has been half inserted.

The protrusion of the retainer 6 can be ascertained visually. However, when the connector is small, the degree to which the retainer 6 protrudes is extremely small. Consequently, it is difficult to ascertain whether it is in the main stopping position, and the protrusion of the retainer 6 might not be noticed.

The present invention has been developed after taking the above problem into consideration, and aims to present a terminal fitting wherein a half-inserted state can reliably be detected by a retainer.

SUMMARY OF THE INVENTION

According to the invention there is provided an electrical terminal for insertion into a connector body, the terminal having an anterior end for connection to a mating terminal, a posterior end for connection to an electrical wire, and a mid-portion having a recess adapted to receive a retainer, wherein said terminal further comprises an upstanding projection at the anterior side of said recess, said projection having an upper side for contact with a retainer in a half fitted state with said connector body, and a posterior side for contact with a retainer in a fully fitted state with said connector body.

Such a terminal has an upstanding projection adapted to prevent insertion of the retainer before the retainer has been inserted a significant distance. Accordingly the retainer protrudes to a greater degree compared with the prior art, and half-fitting is more likely to be noticed.

The projection may be a part sheared tab or an outward indentation. The tab may be rectangular in elevation and aligned with a stabilizing tab to the anterior thereof.

Preferably the projection and recess are coincident at one respective end so as to provide a single plane of contact for the retainer.

The retainer is preferably insertable at an acute angle to the direction of insertion of the terminal, and may have temporary and final positions determined by a releasable resilient latch thereof.

BRIEF DESCRIPTION OF THE DRAWINGS

Other features of the invention will be apparent from the following description of several preferred embodiments shown by way of example only in the accompanying drawings in which.

FIRST EMBODIMENT

Figure 2:
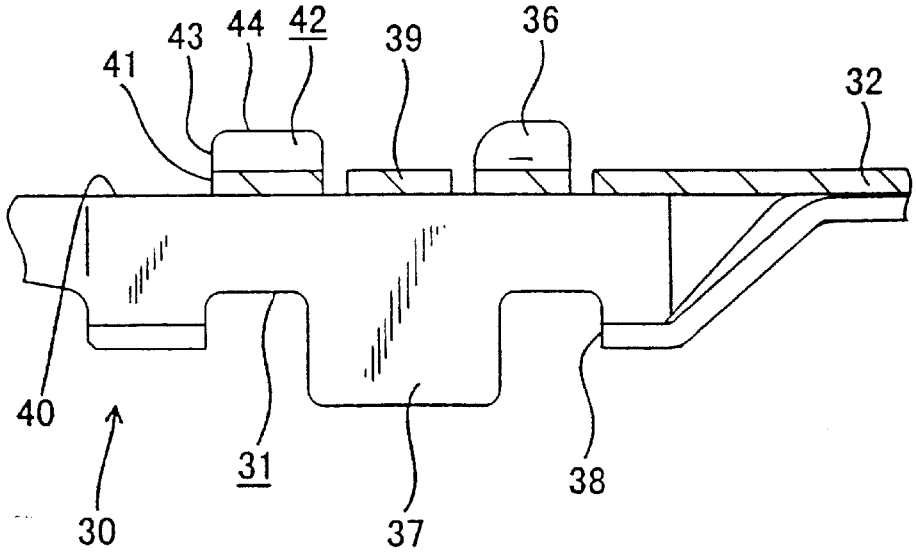
FIG. 2 is a side cross-sectional view of the terminal fitting.
Figure 3:
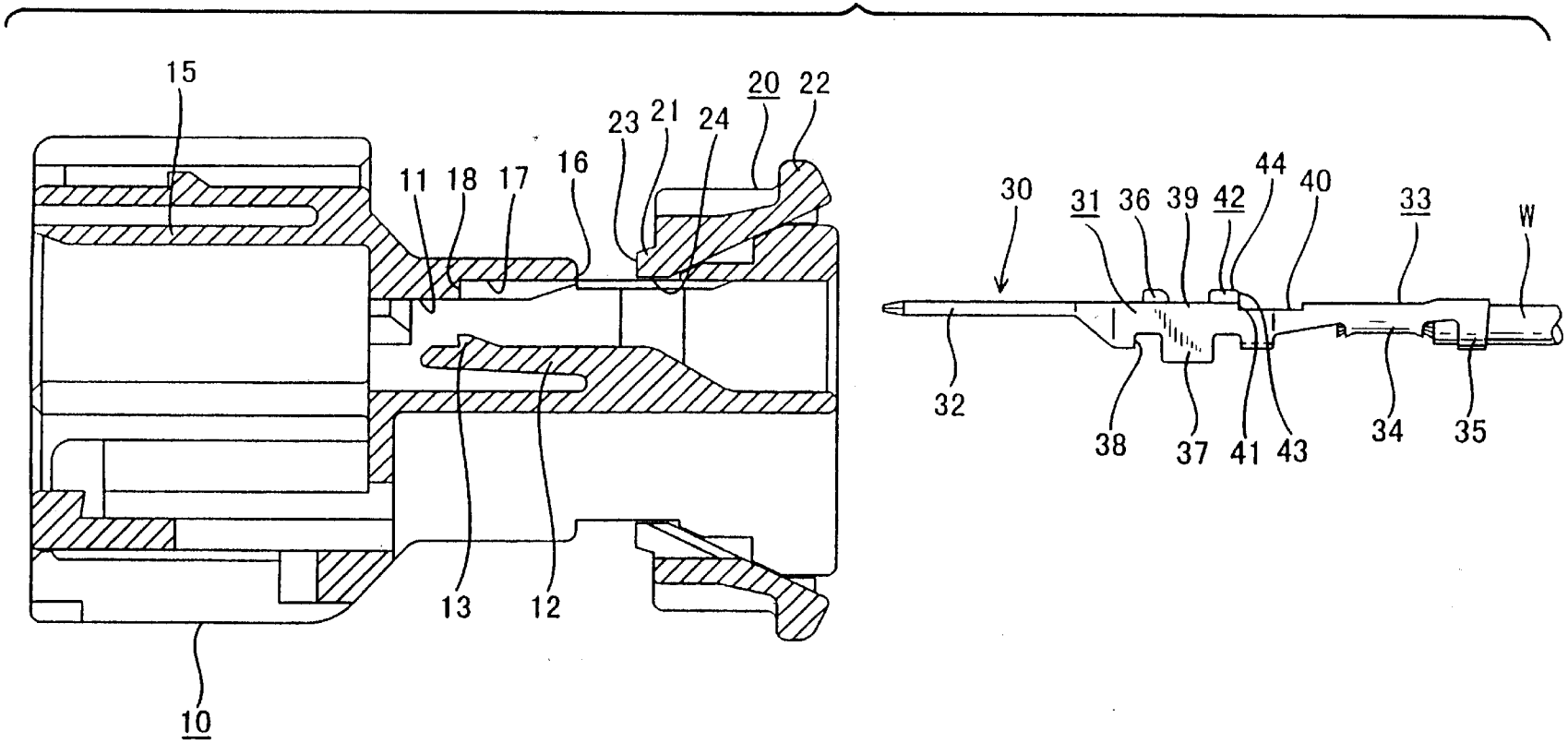
FIG. 3 is a partially cut-away side face view of the terminal fitting in a state prior to being inserted into a housing.

A first embodiment of the present invention will be explained with the aid of FIGS. 1 to 7. A male terminal fitting 30 is described first. As shown in FIG. 3, this male terminal fitting 30 is inserted into a connector housing 10 provided with a retainer 20 which is inserted diagonally from a posterior direction.

Figure 1:
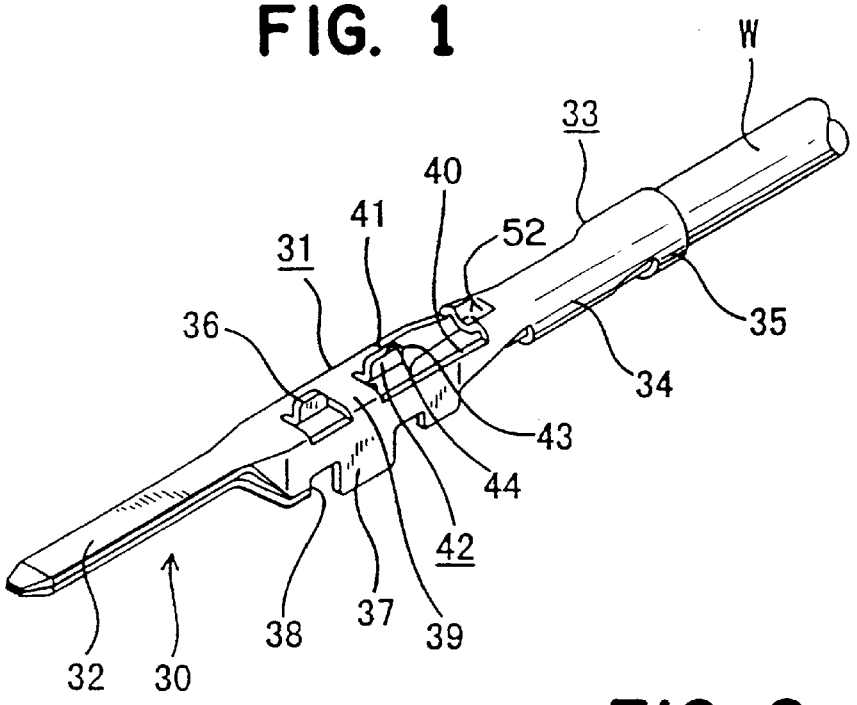
FIG. 1 is a diagonal view showing a terminal fitting of a first embodiment of the present invention.

As shown in FIG. 1, a central portion along a lengthwise direction of the terminal fitting 30 is provided with an approximately box-shaped main body 31. A tab 32 capable of joining with a corresponding female terminal fitting (not shown) protrudes from the anterior thereof. A joining member 33 is formed behind the main body 31, an electric wire W being joined thereto by crimping. The joining member 33 consists of a wire barrel 34 which crimps core wires protruding from the end of the electric wire W, and an insulation barrel 35 which crimps the cover of the electric wire W. The wire barrel 34 is formed at the anterior, and the insulation barrel 35 is formed at the posterior.

A stabiliser 36 is formed by cutting a side edge located at an anterior portion (anterior relative to FIG. 1) of an upper face of the main body 31. This stabiliser 36 protrudes upwards along a lengthwise direction at approximately a right angle from an approximate centre of the upper face of the main body 31. In addition, a pair of stabilizers 37 protrude downwards from both lower side edges of the centre along a lengthwise direction of the main body 31. Stopping cavities 38 are formed to the anterior of the stabilizers 37, lances 12 of the housing 10 engaging therewith. Further, the stabilizers 36 and 37 also serve to stabilise the insertion of the terminal fitting 30 into the housing 10, preventing the terminal fitting 30 from being inserted upside-down, etc.

As shown in FIG. 3, upper and lower cavities 11 for housing the terminal fittings 30 are formed in the housing 10, the cavities 11 being aligned in a width-wise direction. Only the upper cavities 11 will be explained below. The bendable lance 12, which is formed in a cantilevered shape, protrudes from a lower face of the cavity 11, a free end of this lance 12 protruding towards the anterior. A stopping protrusion 13 protrudes from an upper face of the free end of the lance 12, this stopping protrusion 13 engaging with the stopping cavity 38 of the terminal fitting 30. A groove (not shown) is formed on both sides of the lance 12, the pair of stabilizers 37 of the terminal fitting 30 being inserted therealong so as to grip the lance 12. Further, a hood 15 which is open to the anterior is formed at an anterior portion of the housing 10, a corresponding housing fitting therewith.

An opening 16 which intersects with each cavity 11 is formed at the centre, with respect to the length-wise direction, of an upper face of the cavity 11. A groove 17, located in front of the opening 16 is formed in the upper face of the cavity 11 and extends for a specified length in an anterior direction. The stabiliser 36 of the terminal fitting 30 is inserted into this groove 17 and makes contact with an anterior wall 18 thereof. The retainer 20 for retaining the terminal fitting 30 is inserted through the opening 16.

The retainer 20 is maintained in the housing 10 by a maintaining mechanism (not shown, but for example a resilient latch) and is capable of moving diagonally in an anterior-posterior direction. Stopping members 21 which correspond with each cavity 11 protrude diagonally towards the anterior from an inner face of each retainer 20, these stopping members 21 engaging with each terminal fitting 30. The positions in which each retainer 20 is maintained in the housing 10 are a temporary stopping position, shown in FIG. 4, whereby the stopping member 21 is outside the cavity 11, the terminal fitting 30 therefore being allowed to be inserted into the cavity 11. and a main stopping position, shown in FIG. 5, whereby the retainer 20 is inserted further towards the anterior than it is in the temporary stopping position, the stopping member 21 thereby being inserted into the interior of the cavity 11, and the terminal fitting 30 being maintained in a retained state.

Figure 4:
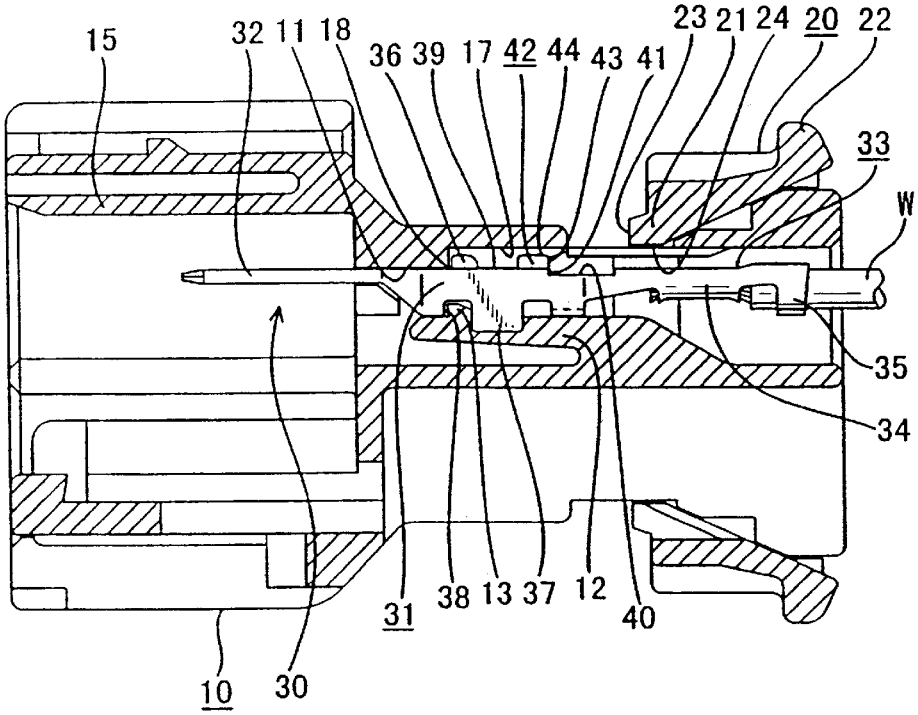
FIG. 4 is a partially cut-away side face view of the terminal fitting inserted to a correct depth.

An operating member 22 is formed on a posterior end of the retainer 20. As shown in FIG. 4, when the retainer 20 is in the temporary stopping position, a posterior end of the operating member 22 is located in approximately the same position as a posterior end of the housing 10. If this operating member 22 is pressed, the retainer 20, which is in the temporary stopping position, is pressed diagonally to the anterior, and is moved into the main stopping position shown in FIG. 5.

The relationship between the terminal fitting 30 and the retainer 20 will now be explained in detail. As shown in FIG. 4, the upper face of the main body 31, on which the stabiliser 36 is provided, constitutes an opposing face 39 located in the vicinity of the opening 16 in the upper portion of the housing 10 and the retainer 20, this opposing face 39 being opposite the retainer 20. A recess 40 is formed in the upper face of the main body 31, at a posterior end of the opposing face 39. The stopping member 21 of the retainer 20 can be inserted into this recess 40 (see FIG. 5). An anterior face 23 of the inserted stopping member 21 strikes against a posterior end face of the opposing face 39 in the vicinity of the recess 40, thereby retaining the terminal fitting 30. This posterior end face of the opposing face 39 constitutes a stopping end face 41 which is opposite the stopping member 21 of the retainer 20.

Figure 5:
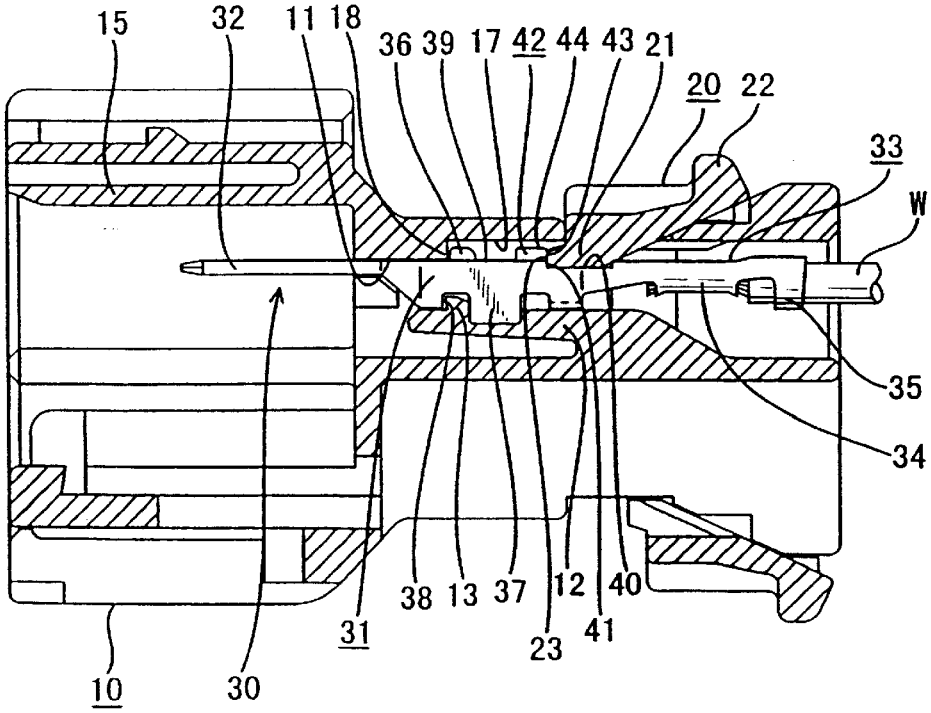
FIG. 5 is a partially cut-away side face view showing a retainer moved to a main stopping position.
Figure 7:
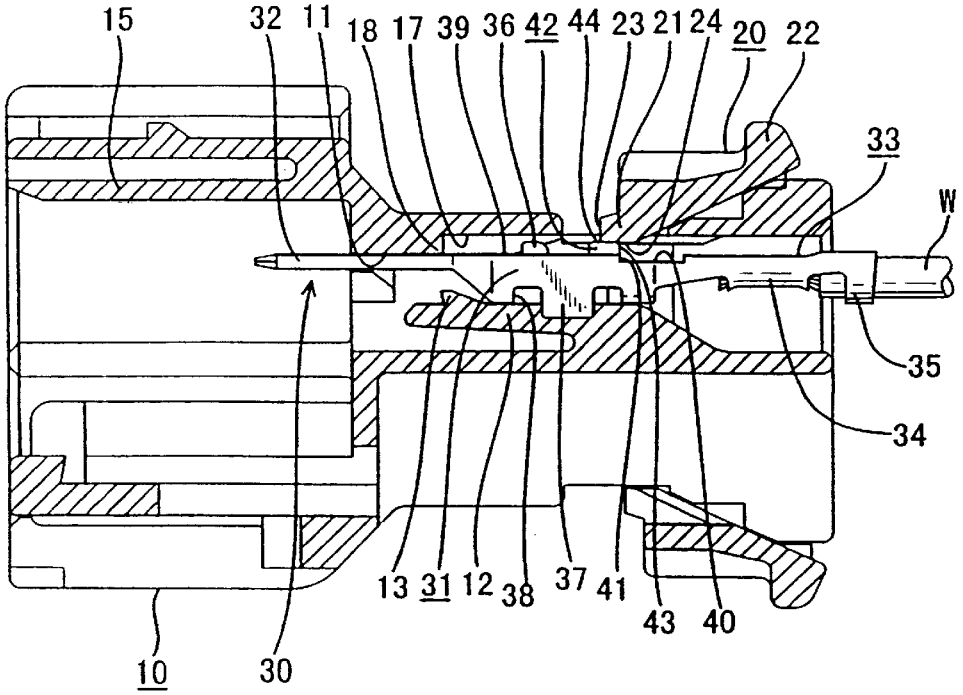
FIG. 7 is a partially cut-away side face view showing half-insertion of the terminal fitting being detected.

A detecting protrusion 42 of the present invention is formed on a posterior end portion of the opposing face 39 of the main body 31. As shown in FIG. 1, the detecting protrusion 42 is located to the posterior of the stabiliser 36 and is formed by cutting a specified length of a side edge of the posterior end of the opposing face 39 and causing it to protrude upwards at approximately a right angle from an approximate centre, with respect to a width, of the opposing face 39. As shown in FIG. 2, a posterior end face 43 of the detecting protrusion 42 forms a single face with the stopping end face 41 and, as shown in FIG. 5, the stopping member 21 of the retainer 20, which has been inserted to the main stopping position, strikes against the posterior end face 43 and the stopping end face 41. As shown in FIGS. 1 and 2, the detecting protrusion 42 is formed in a straight line with respect to the stabiliser 36, and an upper face of the detecting protrusion 42 has approximately the same height as the stabiliser 36. Moreover, as shown in FIG. 7, depending on the depth to which the terminal fitting 30 is inserted into the cavity 11, a lower face 24 of the stopping member 21 of the retainer 20 can strike against an upper face 44 of the detecting protrusion 42.

Since the detecting protrusion 42 and stabiliser 36 are aligned with the insertion axis, only a single groove 17 is required. This arrangement avoids two separate grooves and the consequent weakening of the housing 10.

The posterior face of the protrusion 42 is 'L' shaped, by virtue of the retainer aperture, thus presenting a relatively larger surface area to the retainer than would be the case with a simple tab.

Figure 2A:
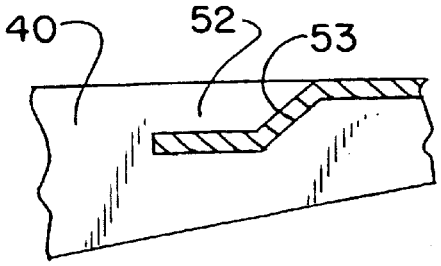
FIG. 2*a* is a scrap cross-section through part of the terminal fittings on an enlarged scale.

FIGS. 1 and 2*a* also illustrate an indentation 52 to the rear of the recess 40 in the terminal 30. This indentation has an upwardly and rearwardly sloping rear edge 53 which is approximately at the same angle as the insertion angle of the retainer.

This sloping edge permits a retainer to move to the correct insertion depth notwithstanding that due to tolerances the terminal may be slightly rearward of the correct position. Whilst this problem could be alleviated by making the retainer rather slim. such a retainer would be rather weak given that the terminals are in practice very small. A slim retainer would also have a reduced latching force.

Alternatively the terminal would inevitably be longer in order to avoid a collision of components, thus increasing cost.

The present embodiment is configured as described above. Next, the operation thereof is described. First, as shown in FIG. 3, the retainer 20 is attached in the temporary stopping position to the housing 10, and the terminal fitting 30 is inserted into the cavity 11. At this juncture, the stabiliser 36 and then the detecting protrusion 42 of the opposing face 39 enter the groove 17. As shown in FIG. 4, the terminal fitting 30 is inserted to a specified depth, then the stabiliser 36 strikes against the anterior wall 18 of the groove 17, thereby retaining the terminal fitting 30 in the anterior direction. At the same time, the lance 12, which had been resiliently bent by the anterior end of the main body 31, returns to its original position, the stopping protrusion 13 engages with the stopping cavity 38, and the retaining of the terminal fitting 30 is completed Next, the operating member 22 is pressed, pushing the retainer 20 in an anterior direction and moving it into the main stopping position shown in FIG. 5. Then the stopping member 21, which was away from the cavity 11, enters the recess 40 of the terminal fitting 30, and the anterior face 23 of the stopping member 21 strikes against the stopping end face 41 of the terminal fitting 30 and the posterior end face 43 of the detecting protrusion 42. By this means, the retainer 20 maintains the terminal fitting 30 unremovably in the cavity 11 in a doubly retained state.

Even if the anterior of the terminal fitting 30, which is housed in the cavity 11, is made to incline upwards, the terminal fitting 30 will not be damaged by engaging with the stopping member 21. This is because the range over which the retainer 20 engages with the terminal fitting 30 has been increased by making the detecting protrusion 42 protrude upwards.

Figure 6:
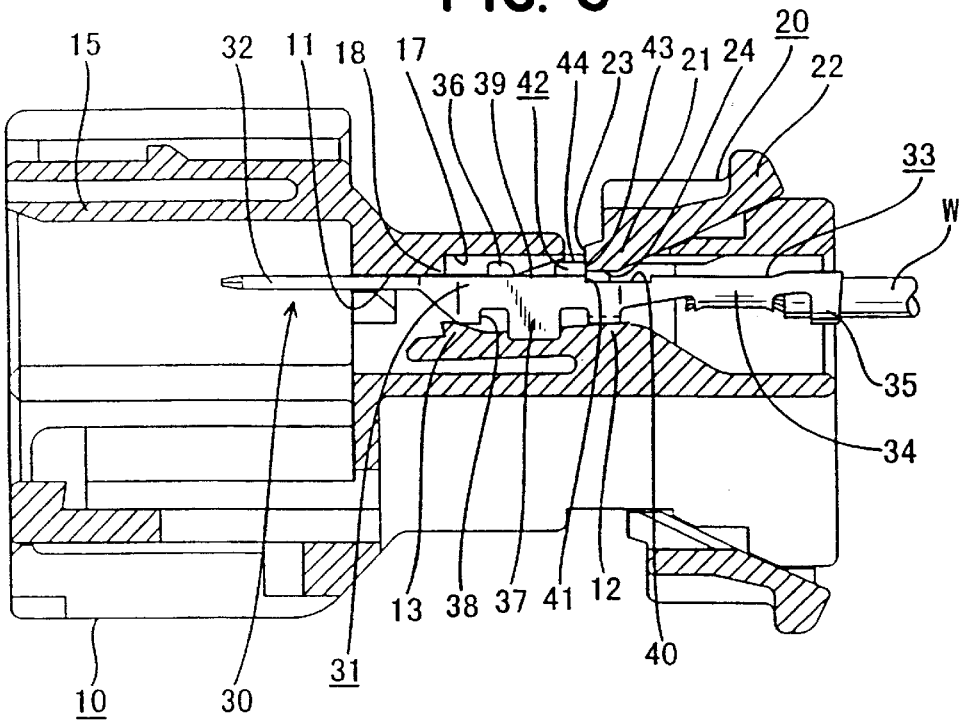
FIG. 6 is a partially cut-away side face view showing the terminal fitting being pushed in by the retainer.

Further if the terminal fitting 30 is not inserted to a sufficient depth, the terminal fitting 30 halts in the position shown in FIG. 6. In this case, if the retainer 20 is pressed towards the main stopping position, the anterior end face of the stopping member 21 of the retainer 20 strikes against an upper portion of the posterior end face 43 of the detecting protrusion 42, the pressing of the retainer 20 automatically pushing the terminal fitting 30 towards the anterior. That is, pressing the retainer 20 pushes the terminal fitting 30 to the correct inserted depth shown in FIG. 5.

The terminal fitting 30 may be inserted to a depth short of the position shown in FIG. 6. This half-inserted state of the terminal fitting 30 is shown in FIG. 7. In this case, if the retainer 20 is pressed, the lower face 24 of the stopping member 21 of the retainer 20 strikes against the upper face 44 of the detecting protrusion 42. If the retainer 20 is pressed towards the interior from this state, the terminal fitting 30 hardly moves, and the further pressing-in of the retainer 20 is thereby prevented. By this means, the half-inserted state of the terminal fitting 30 can be detected.

When the half-inserted state of the terminal fitting 30 is detected, the retainer 20 is in a more shallowly inserted state than, for example, when the movement of the retainer 20 is prevented by its stopping member 21 striking against the opposing face 39 of the terminal fitting 30. The amount of protrusion of the retainer 20 is determined by the height of the detecting protrusion 42. That is, the half-inserted state of the terminal fitting 30 can be detected early due to the height of the detecting protrusion 42. By this means, the retainer 20 needs to be moved only a little from the temporary stopping position before its movement is halted. There can be no confusion between this and the case where the retainer 20 is pressed into the main stopping position shown in FIG. 5 and its movement is halted. Consequently, the half-inserted state of the terminal fitting 30 can be detected readily.

According to the embodiment described above, the position of the half-inserted retainer 20 is higher than the position of the retainer 20 in the main stopping position. Consequently, the half-inserted state of the terminal fitting 30 can be detected reliably. Further, the detecting protrusion 42 can be inserted into the groove 17 of the housing 10 into which the stabiliser 36 is inserted. Consequently, the housing 10 need not be provided with a recessed groove specially for the detecting protrusion 42, and the configuration of the housing 10 is thereby simplified.

SECOND EMBODIMENTS

Next, a second embodiment of the present invention will be explained with the aid of FIGS. 8 to 10. The second embodiment explains a terminal fitting having a detecting member with a different shape.

Figure 8:
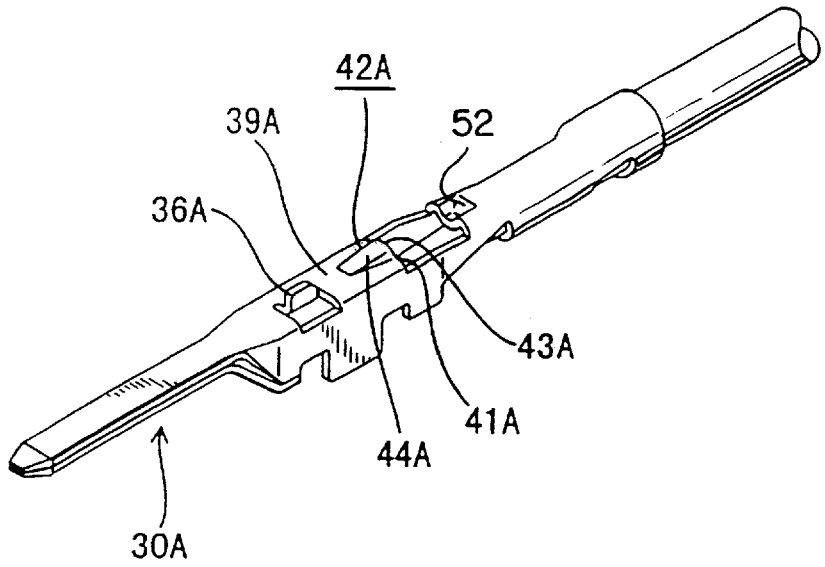
FIG. 8 is a diagonal view of a terminal fitting of a second embodiment of the present invention.
Figure 9:
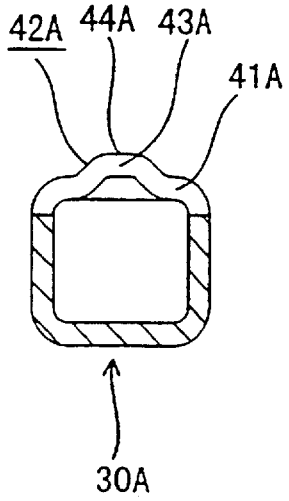
FIG. 9 is a cross-sectional view of the terminal fitting of FIG. 8.

As shown in FIG. 8, a detecting protrusion 42A of a terminal fitting 30A is formed by pressing out a posterior portion of an opposing face 39A. This detecting protrusion 42A is inclined from the anterior to the posterior, the posterior end thereof being higher when viewed from a length-wise direction. When viewed from a width-wise direction, as shown in FIG. 9, the detecting protrusion 42A has a symmetrical shape with the central position thereof being higher. The highest portion of the detecting protrusion 42A, which is the central position of the posterior end thereof, has approximately the same height as a stabiliser 36A located to the anterior. Moreover, a posterior end face 43A of the detecting protrusion 42A forms a single face with a stopping end face 41A. Further, as shown in FIG. 10, a housing member 19 for housing the detecting protrusion 42A is formed in a posterior portion of a groove 17 of a housing 10. The housing member 19 has a shape corresponding to the detecting protrusion 42A.

Figure 10:
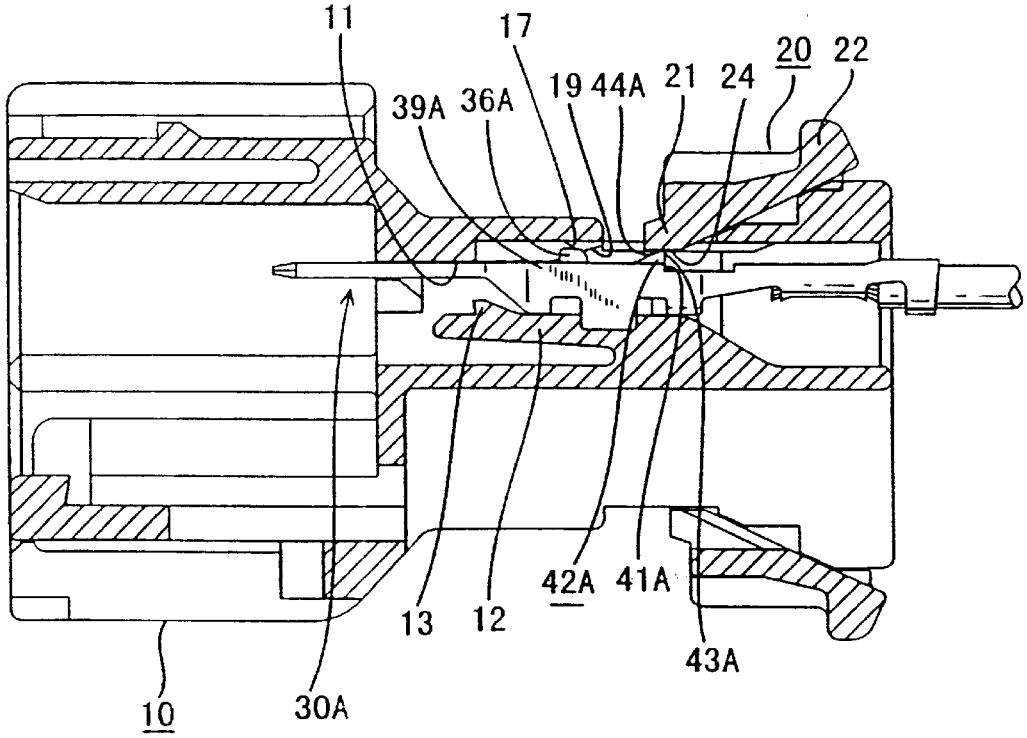
FIG. 10 is a partially cut-away side face view showing half-insertion of the terminal fitting being detected.
Figure 11:
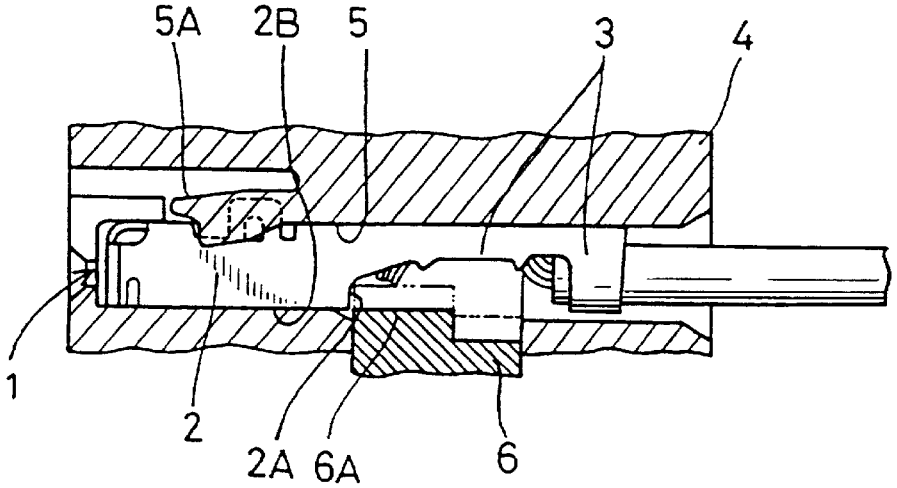
FIG. 11 PRIOR ART
FIG. 11 is a cross-sectional view of a conventional example.

If the terminal fitting 30A is in the half-inserted state shown in FIG. 10, a lower face 24 of a stopping member 21 of a retainer 20 strikes against an inclined face 44A of the detecting protrusion 42A, thereby preventing the retainer 20 from being pressed in and allowing the half-insertion of the terminal fitting 30A to be detected.

The detecting protrusion 42A is formed by pressing. Consequently, the terminal fitting 30A having the detecting protrusion 42A maintains a greater strength than in the first embodiment, where the detecting protrusion 42 is formed by cutting-away. The retaining configuration, operation and effects are the same as in the first embodiment, and an explanation thereof is omitted. However it will be seen that the posterior side of the protrusion 42A presents a larger surface area to the retainer than would be the case if a planar tab was provided. This larger surface area spreads the load on the retainer and prevents consequent indentation.

The present invention is not limited to the embodiments described above. For example, the possibilities described below also lie within the technical range of the present invention. In addition, the present invention may be embodied in various other ways without deviating from the scope thereof.

(1) The present invention is not limited to male terminal fittings; it is, of course, equally applicable to female terminal fittings.

(2) In the embodiment described above, the terminal fittings have been used in a housing provided with a retainer which is inserted in a diagonal direction. However, they may also be used in a housing in which the retainer is inserted in a direction at right angles with respect to the direction of insertion of the terminal fittings.

(3) In the embodiment described above, the detecting protrusion is provided on the posterior of the opposing face which is opposite the retainer. However, it need not be provided on the posterior. In particular, when the detecting protrusion is formed by cutting-away, as in the first embodiment, the strength of the terminal fitting can be maintained if the detecting protrusion is formed at a location somewhat further towards the anterior, with a bridging portion remaining at the posterior of the opposing face.

What is claimed is:

1. An electrical terminal for insertion into a connector body, the terminal having an anterior end for connection to a mating terminal, a posterior end for connection to an electrical wire, and a mid-portion having a recess adapted to receive a retainer, wherein said terminal further comprises an upstanding projection at the anterior side of said recess, said projection having an upper side for contact with the retainer in a half fitted state with said connector body, and a posterior side for contact with the retainer in a fully fitted state with said connector body, and wherein said upstanding projection projects above an uppermost wall of the anterior end forming a connection to a mating terminal so that the retainer abuts the projection and projects upward as an indicator when the terminal is in a half-fitted state.

2. A terminal according to claim 1 where said projection comprises a tab part-sheared from said mid-portion.

3. A terminal according to claim 2 wherein said tab is substantially rectangular in elevation.

4. A terminal according to claim 2 wherein said mid-portion is symmetrical, and said tab is on the axial centerline thereof.

5. A terminal according to claim 3 wherein said mid-portion is symmetrical, and said tab is on the axial centerline thereof.

6. A terminal according to claim 4 and further including a stabiliser anterior to said tab, said stabiliser also comprising an upstanding projection part-sheared from said mid-portion, and said stabiliser and tab being aligned axially.

7. A terminal according to claim 5 and further including a stabiliser anterior to said tab, said stabiliser also comprising an upstanding projection part-sheared from said mid-portion, and said stabiliser and tab being aligned axially.

8. A terminal according to claim 6 wherein said projection presents an 'L' shaped surface to the posterior, for abutment with a retainer in use.

9. A terminal according to claim 7 wherein said projection presents an 'L' shaped surface to the posterior, for abutment with a retainer in use.

10. A terminal according to claim 1 wherein said projection comprises an outward indentation of said mid-portion.

11. A terminal according to claim 10 wherein the upper side of said indentation slopes down towards the anterior.

12. A terminal according to claim 11 wherein said indentation presents an arc-like surface to the posterior, for abutment with a retainer in use.

13. A terminal according to claim 1 and further including an indentation to the posterior of said recess, said indentation being adapted to receive a retainer for said terminal.

14. A terminal according to claim 13 wherein the posterior side of said indentation is angled towards the posterior end.

15. A terminal according to claim 1 wherein said posterior side is aligned with an anterior edge of said recess.

16. An electrical connector comprising a body and a terminal according to claim 1, said body having a cavity, said terminal being insertable into said cavity, and said body further including a side opening for said cavity and adapted to receive a retainer for said terminal, said body having means to guide insertion of said retainer at an acute angle to the direction of insertion of said terminal.

17. An electrical terminal for insertion into a connector body, the terminal having an anterior end for connection to a mating terminal, a posterior end for connection to an electrical wire, and a mid-portion having a recess adapted to receive a retainer, wherein said terminal further comprises an upstanding projection at the anterior side of said recess, said projection having an upper side for contact with the retainer in a half fitted state with said connector body, and a posterior side for contact with the retainer in a fully fitted state with said connector body, wherein said upstanding projection projects from an upper surface adjacent the anterior end of the recess so that the retainer abuts the projection and projects upward as an indicator that the terminal is in a half-fitted state.

* * * * *